US005881583A

United States Patent [19]

Booker et al.

[11] Patent Number: 5,881,583

[45] Date of Patent: Mar. 16, 1999

[54] BASKETBALL RIM LOCKING COVER

[76] Inventors: Kenith L. Booker; Bettye J. Booker, both of 420 Rosedon Dr., Montgomery, Ala. 36116

[21] Appl. No.: 903,600

[22] Filed: Jul. 31, 1997

[51] Int. Cl.[6] ..... E05B 65/00; A63B 63/00

[52] U.S. Cl. ..... 70/57; 70/163; 70/209; 473/485; D8/331

[58] Field of Search ..... 70/57, 163–168, 70/209, 158, 167–169, 170–173, 416, 417, 212, 226; 473/485; D8/331

[56] References Cited

U.S. PATENT DOCUMENTS

| | | | |
|---|---|---|---|
| 1,005,434 | 10/1911 | Kinney | 70/164 |
| 2,710,189 | 6/1955 | Carroll . | |
| 2,841,658 | 7/1958 | Dawkins | 70/163 |
| 3,264,850 | 8/1966 | Bower | 70/165 |
| 3,457,745 | 7/1969 | Barber | 70/209 |
| 4,913,265 | 4/1990 | Richards | 70/226 |
| 5,415,018 | 5/1995 | Ferrante | 70/209 |
| 5,433,095 | 7/1995 | Mitchell et al. | 70/57 |
| 5,439,210 | 8/1995 | Davis | 70/57 |
| 5,491,900 | 2/1996 | Von-Lambert | 70/209 |
| 5,582,401 | 12/1996 | Malone | 70/57 |
| 5,628,507 | 5/1997 | Johnson . | |

*Primary Examiner*—Darnell M. Boucher

[57] ABSTRACT

A new BASKETBALL RIM LOCKING COVER for PREVENTING UNAUTHORIZED USE OF A BASKETBALL HOOP. The inventive device includes a cover member having a circular configuration. The cover member has a diameter greater than a diameter of a basketball rim. A pair of diametrically opposed coupling members are secured to the planar lower surface of the cover member disposed inwardly of the peripheral edge for engaging the basketball rim.

1 Claim, 2 Drawing Sheets

FIG 3
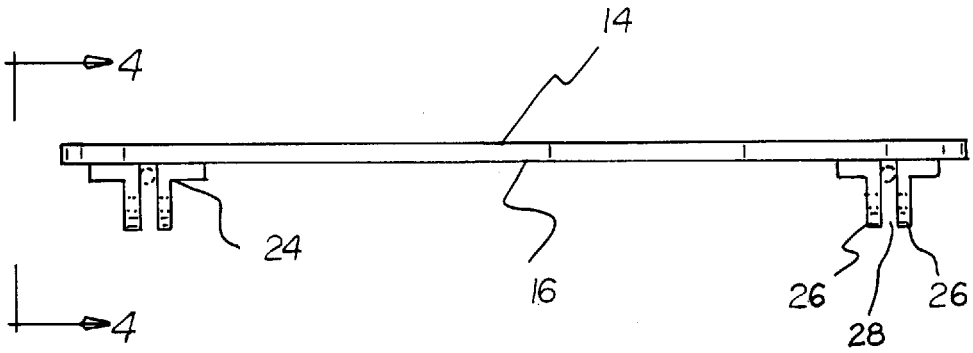
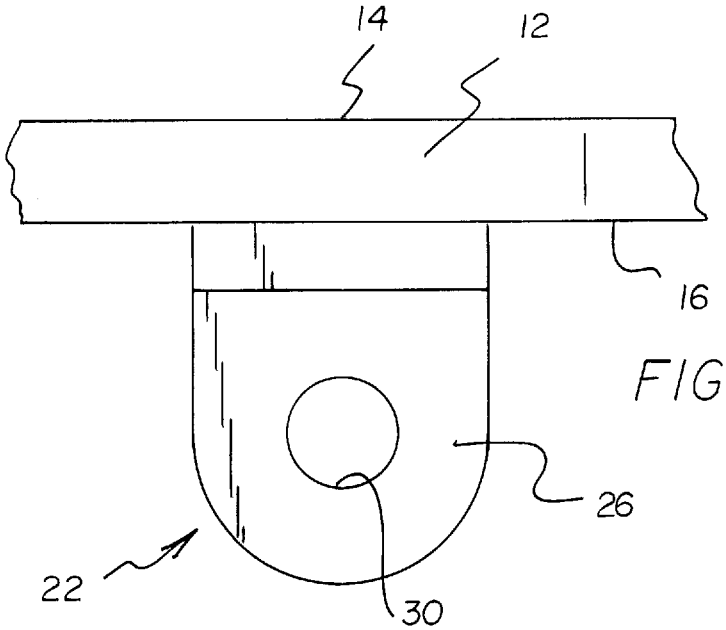
FIG 4

BASKETBALL RIM LOCKING COVER

BACKGROUND OF THE INVENTION

1. Field of the Invention

The present invention relates to BASKETBALL HOOP LOCKS and more particularly pertains to a new BASKETBALL RIM LOCKING COVER for PREVENTING UNAUTHORIZED USE OF A BASKETBALL HOOP.

2. Description of the Prior Art

The use of BASKETBALL HOOP LOCKS is known in the prior art. More specifically, BASKETBALL HOOP LOCKS heretofore devised and utilized are known to consist basically of familiar, expected and obvious structural configurations, notwithstanding the myriad of designs encompassed by the crowded prior art which have been developed for the fulfillment of countless objectives and requirements.

Known prior art BASKETBALL HOOP LOCKS include U.S. Pat. No. 5,433,095 to Mitchell et al.; U.S. Pat. No. 5,439,210 to Davis; U.S. Pat. No. 5,197,308 to Pazik; U.S. Pat. No. 5,440,907 to Shen; U.S. Pat. No. 5,284,037 to Chen et al.; and U.S. Pat. No. Des. 359,448.

While these devices fulfill their respective, particular objectives and requirements, the aforementioned patents do not disclose a new BASKETBALL RIM LOCKING COVER. The inventive device includes a cover member having a circular configuration. The cover member has a diameter greater than a diameter of a basketball rim. A pair of diametrically opposed coupling members are secured to the planar lower surface of the cover member disposed inwardly of the peripheral edge for engaging the basketball rim.

In these respects, the BASKETBALL RIM LOCKING COVER according to the present invention substantially departs from the conventional concepts and designs of the prior art, and in so doing provides an apparatus primarily developed for the purpose of PREVENTING UNAUTHORIZED USE OF A BASKETBALL HOOP.

SUMMARY OF THE INVENTION

In view of the foregoing disadvantages inherent in the known types of BASKETBALL HOOP LOCKS now present in the prior art, the present invention provides a new BASKETBALL RIM LOCKING COVER construction wherein the same can be utilized for PREVENTING UNAUTHORIZED USE OF A BASKETBALL HOOP.

The general purpose of the present invention, which will be described subsequently in greater detail, is to provide a new BASKETBALL RIM LOCKING COVER apparatus and method which has many of the advantages of the BASKETBALL HOOP LOCKS mentioned heretofore and many novel features that result in a new BASKETBALL RIM LOCKING COVER which is not anticipated, rendered obvious, suggested, or even implied by any of the prior art BASKETBALL HOOP LOCKS, either alone or in any combination thereof.

To attain this, the present invention generally comprises a cover member having a circular configuration. The cover member has a planar upper surface, a planar lower surface and a peripheral edge. The cover member has a diameter greater than a diameter of a basketball rim. A pair of diametrically opposed coupling members are secured to the planar lower surface of the cover member disposed inwardly of the peripheral edge. Each of the coupling members has a pair of inverted L-shaped members. Each of the L-shaped members has a downwardly extending portion. A spaced is defined between the downwardly extending portions for receiving the basketball rim therein. Each of the downwardly extending portions has an aperture therethrough. A pair of locks extend between the apertures of the downwardly extending portions of the coupling members for locking the cover member to the basketball rim.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new BASKETBALL RIM LOCKING COVER apparatus and method which has many of the advantages of the BASKETBALL HOOP LOCKS mentioned heretofore and many novel features that result in a new BASKETBALL RIM LOCKING COVER which is not anticipated, rendered obvious, suggested, or even implied by any of the prior art BASKETBALL HOOP LOCKS, either alone or in any combination thereof.

It is another object of the present invention to provide a new BASKETBALL RIM LOCKING COVER which may be easily and efficiently manufactured and marketed.

It is a further object of the present invention to provide a new BASKETBALL RIM LOCKING COVER which is of a durable and reliable construction.

An even further object of the present invention is to provide a new BASKETBALL RIM LOCKING COVER which is susceptible of a low cost of manufacture with regard to both materials and labor, and which accordingly is then susceptible of low prices of sale to the consuming public, thereby making such BASKETBALL RIM LOCKING COVER economically available to the buying public.

Still yet another object of the present invention is to provide a new BASKETBALL RIM LOCKING COVER which provides in the apparatuses and methods of the prior art some of the advantages thereof, while simultaneously overcoming some of the disadvantages normally associated therewith.

Still another object of the present invention is to provide a new BASKETBALL RIM LOCKING COVER for PREVENTING UNAUTHORIZED USE OF A BASKETBALL HOOP.

Yet another object of the present invention is to provide a new BASKETBALL RIM LOCKING COVER which includes a cover member having a circular configuration. The cover member has a diameter greater than a diameter of a basketball rim. A pair of diametrically opposed coupling members are secured to the planar lower surface of the cover member disposed inwardly of the peripheral edge for engaging the basketball rim.

Still yet another object of the present invention is to provide a new BASKETBALL RIM LOCKING COVER that completely covers a the basketball rim.

Even still another object of the present invention is to provide a new BASKETBALL RIM LOCKING COVER that will prevent the net of the rim from being worn down from inclement weather.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the present invention.

FIG. 4 is a side view of the present invention as taken along line 4—4 of FIG. 3.

DESCRIPTION OF THE PREFERRED EMBODIMENT

Figure 1:
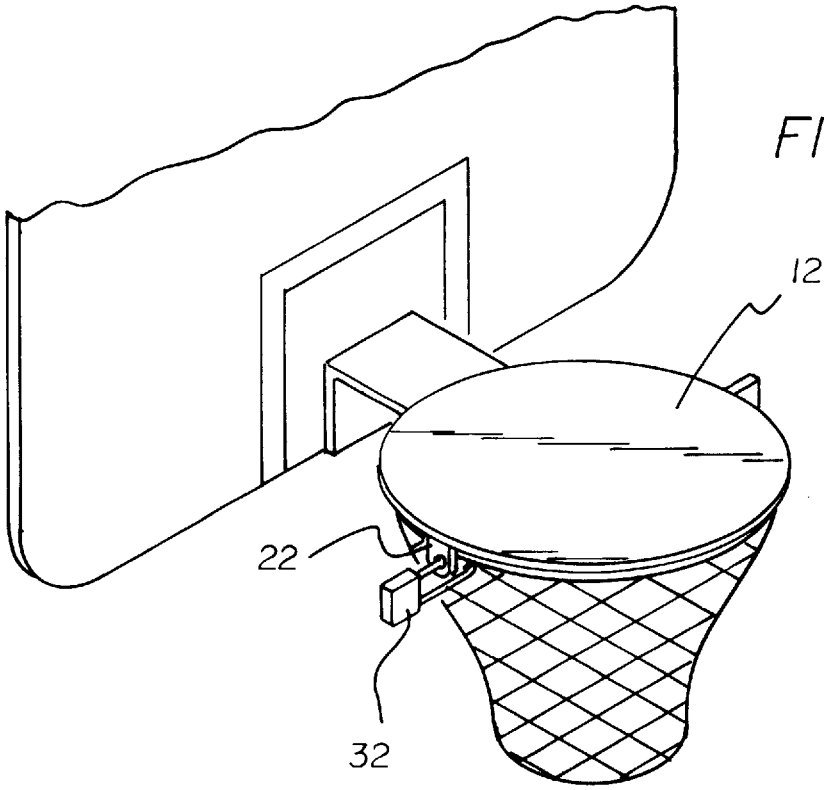
FIG. 1 is a top perspective view of a new BASKETBALL RIM LOCKING COVER according to the present invention.
Figure 2:
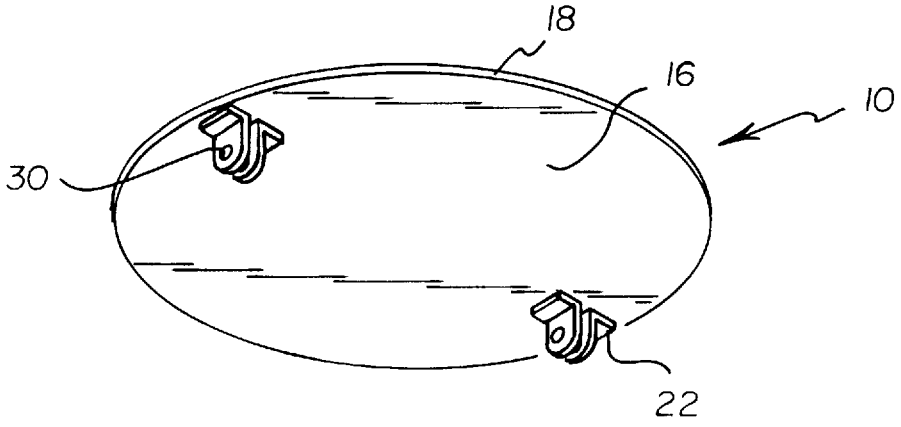
FIG. 2 is a bottom perspective view of the present invention.

With reference now to the drawings, and in particular to FIGS. 1 through 4 thereof, a new BASKETBALL RIM LOCKING COVER embodying the principles and concepts of the present invention and generally designated by the reference numeral 10 will be described.

As best illustrated in FIGS. 1 through 4, the BASKETBALL RIM LOCKING COVER 10 comprises a cover member 12 having a circular configuration. The cover member 12 has a planar upper surface 14, a planar lower surface 16 and a peripheral edge 18. The cover member 12 has a diameter greater than a diameter of a basketball rim 20. Thus, a portion of the cover member 12 will extend outwardly beyond the perimeter of the basketball rim 20. Note FIG. 1.

A pair of diametrically opposed coupling members 22 are secured to the planar lower surface 16 of the cover member 12 disposed inwardly of the peripheral edge 18. Each of the coupling members 22 has a pair of inverted L-shaped members 24. Each of the L-shaped members 24 has a downwardly extending portion 26. A space 28 is defined between the downwardly extending portions 26 for receiving the basketball rim 20 therein. Each of the downwardly extending portions 26 has an aperture 30 therethrough.

A pair of locks 32 extend between the apertures 30 of the downwardly extending portions 26 of the coupling members 22 for locking the cover member 12 to the basketball rim 20.

In use, the cover member 12 is placed atop the basketball rim 20 with the rim 20 received between the coupling members 22. The locks 32 are used to lock the cover member 12 on the basketball rim 20 to preclude the use of the basketball rim 20. The cover member 12 will also prevent the net of the basketball rim 20 from being worn down from contact with rain and other inclement weather.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A basketball rim locking cover system comprising, in combination:

a basketball hoop; a cover member having a closed unitary circular configuration, said cover member having a planar upper surface, a planar lower surface and a peripheral edge, said cover member being adapted to have a diameter greater than a diameter of the basketball rim;

a pair of diametrically opposed coupling members secured to said planar lower surface of said cover member, each of said pair of coupling members being in a fixed position, each of said pair of coupling members being disposed downwardly from said cover member, each of said coupling members being positioned proximate a peripheral edge of said cover member, said pair of coupling members being spaced from each other a distance permitting simultancous alignment of each coupling member with an opposite portion of said basketball rim, each of said coupling members having a pair of inverted L-shaped members, each of said L-shaped members having a downwardly extending portion and a horizontally oriented portion extending away from that of the remaining L-shaped member of the pair of the L-shaped members, a space defined between said downwardly extending portions being adapted such that each of said coupling members is capable of receiving a portion of the basketball rim between said downwardly extending portions such that the rim abuts directly with the cover member, each of said downwardly extending portions having an aperture therethrough; and a lock extending through each of said pair of apertures of said downwardly extending portions of one of said coupling members fur trapping a portion of said rim between said downwardly extending portions to thereby lock said cover member to the basketball rim.

* * * * *